US009180665B2

(12) United States Patent
Nakata et al.

(10) Patent No.: US 9,180,665 B2
(45) Date of Patent: Nov. 10, 2015

(54) RECORDING APPARATUS

(71) Applicant: SEIKO EPSON CORPORATION, Tokyo (JP)

(72) Inventors: Satoshi Nakata, Matsumoto (JP); Akio Todoriki, Matsumoto (JP); Naoki Sakamoto, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/551,963

(22) Filed: Nov. 24, 2014

(65) Prior Publication Data

US 2015/0165798 A1 Jun. 18, 2015

(30) Foreign Application Priority Data

Dec. 18, 2013 (JP) ..... 2013-261113

(51) Int. Cl.

| | |
|---|---|
| ***B41J 23/00*** | (2006.01) |
| ***B41J 2/14*** | (2006.01) |
| ***B41J 19/00*** | (2006.01) |

(52) U.S. Cl.

CPC ... *B41J 2/14* (2013.01); *B41J 19/00* (2013.01)

(58) Field of Classification Search

CPC ..... B41J 2/16508; B41J 29/02; B41J 29/08; B41J 29/10; B41J 11/22

See application file for complete search history.

(56) References Cited

U.S. PATENT DOCUMENTS

| | | | | |
|---|---|---|---|---|
| 5,413,427 | A * | 5/1995 | Giles et al. | 400/691 |
| 7,835,663 | B2 * | 11/2010 | Tomatsu | 399/107 |
| 2005/0030554 | A1 * | 2/2005 | Dixon et al. | 358/1.1 |
| 2010/0245515 | A1 * | 9/2010 | Uchida et al. | 347/104 |

FOREIGN PATENT DOCUMENTS

| | | |
|---|---|---|
| JP | 10-138607 | 5/1998 |
| JP | 2001-001593 | 1/2001 |

* cited by examiner

*Primary Examiner* — Geoffrey Mruk

(74) *Attorney, Agent, or Firm* — Workman Nydegger

(57) ABSTRACT

A printer includes a carriage which includes a recording head which performs recording on a sheet, and can move in a predetermined direction, and a frame assembly which is configured of a plurality of frames which configure the periphery of the carriage. The frame assembly is formed by including a main frame, side frames, and a sub-frame as a first frame which does not form a contact face which comes into contact with the carriage, and guide frames as a second frame which forms the contact face, and of which hardness is higher than that of the first frame.

13 Claims, 12 Drawing Sheets

RECORDING APPARATUS

BACKGROUND

1. Technical Field

The present invention relates to a recording apparatus which is represented by a facsimile, a printer, or the like.

2. Related Art

In a printer as an example of a recording apparatus, in general, the outer side is configured of a housing which is formed of a resin, and an apparatus main body is configured on the inside thereof. In many cases, the apparatus main body is configured of a metal frame, and various constituent elements are assembled in the metal frame.

In a printer disclosed in JP-A-10-138607, improvement of abrasion resistance, a vibration control property, and corrosion resistance is realized using manganese steel in which quantity of carbon is reduced, and quantity of manganese is increased.

In a printer, there is a mobile type which is portable, in addition to a stationary type. In the mobile type printer, there is a strong demand for weight reduction, in particular, due to the very nature. In addition, impact resistance when being dropped is also needed, and weight reduction is also important when considering such a point of view. In addition, in the printer, a ratio of a weight of a frame which constitutes a build of a main body of an apparatus to the whole weight is large, and accordingly, it is preferable to reduce the weight of the frame in the mobile type printer.

Therefore, as a material of the frame, aluminum, an aluminum alloy, or the like, which has relatively small specific gravity is also taken into consideration; however, when adopting such a material with small specific gravity, there is a problem in that the following problem occurs due to the very nature of the printer. For example, in a so-called serial printer in which recording is performed while moving a carriage including a recording head in a sheet width direction, there is a case of adopting a configuration in which the carriage slides on a frame while being supported by the frame. In this case, metal with small specific gravity such as aluminum, the aluminum alloy, or the like, is inferior to metal with greater specific gravity than that when considering abrasion resistance, and causes a problem in durability of a printer.

On the other hand, it is preferable to use stainless steel when considering abrasion resistance; however, stainless steel has large specific gravity, and accordingly, it is not possible to achieve weight reduction of the apparatus.

SUMMARY

An advantage of some aspects of the invention is to improve required performance which is unique in a mobile printer represented by weight reduction or impact resistance while obtaining necessary abrasion resistance.

According to an aspect of the invention, there is provided a recording apparatus which includes a carriage including a recording head which performs recording on a medium, and can move in a predetermined direction; and a plurality of frames which are configured along the carriage, in which the plurality of frames are formed by including a first frame which does not form a contact face which comes into contact with the carriage, and a second frame which forms the contact face, and of which hardness is higher than that of the first frame.

According to the aspect, since the plurality of frames which configure the periphery of the carriage are formed by including the first frame which does not form the contact face which comes into contact with the carriage, and the second frame which forms the contact face, and of which the hardness is higher than that of the first frame, it is possible to realize weight reduction using the first frame while securing abrasion resistance on a sliding face on which the carriage slides uses the second frame.

According to another aspect of the invention, there is provided a recording apparatus which includes a carriage including a recording head which performs recording on a medium, and can move in a predetermined direction; and a frame which is configured along the carriage, in which a sheet member with higher hardness than that of the frame is provided between the frame and the carriage, and the carriage slides on the sheet member along with a movement of the carriage.

According to the aspect, since the sheet member with higher hardness than the frame is provided between the frame and the carriage, and the carriage slides on the sheet member along with a movement of the carriage, it is possible to use a material with small specific gravity in the frame while securing abrasion resistance of a sliding face on which the carriage slides using the sheet member, that is, it is possible to realize weight reduction in the whole apparatus.

According to still another aspect of the invention, there is provided a recording apparatus which includes a carriage including a recording head which performs recording on a medium, and can move in a predetermined direction; and a support member which supports or guides the carriage, in which a guide member with higher hardness than that of the support member is provided on a contact face with the carriage of the support member.

According to the aspect, since the support member which supports or guides the carriage is included, and the guide member with higher hardness than that of the support member is provided on the contact face with the carriage of the support member, it is possible to realize weight reduction using the support member, while securing abrasion resistance on the sliding face on which the carriage slides using the guide member.

In addition, since specific gravity of the first frame which is located on the outer side is less than that of the second frame which is located at the inner side, a weight in the vicinity of the outside of the apparatus becomes light in the whole apparatus. Due to this, an impact when the apparatus is inclined to an installation face of the apparatus, and the apparatus lands on the installation face after taking hands away from the apparatus, is relieved. As a result, in a recording apparatus in which a recording head ejecting, specifically, ink, is provided, it is possible to suppress dot omission which occurs along with drop impact.

In the recording apparatus, the first frame may be formed of aluminum or an aluminum alloy.

According to the aspect, since the first frame is formed of aluminum or an aluminum alloy, it is possible to realize weight reduction using the first frame.

In the recording apparatus, a medium support member which supports a medium may be further included at a position of facing the recording head, in which the medium support member may be fixed to the first frame.

The recording apparatus may further include a carriage driving motor which drives the carriage, and a medium transport motor which drives a transport unit for transporting a medium, in which the carriage driving motor and the medium transport motor may be fixed to the first frame.

The recording apparatus may further include a roller support member which supports a driven roller which is rotated by being in contact with a medium, in which the roller support member may be fixed to the first frame.

In the recording apparatus, an insulating material may be provided between the first frame and the second frame at a junction of the first frame and the second frame.

When a difference in ionization tendencies between metals is present in a case in which metal of different types come into contact with each other, corrosion occurs. According to the aspect, since the insulating material is provided between the first frame and the second frame at the junction of the first frame and the second frame, it is possible to prevent or suppress corrosion which is caused due to the difference in ionization tendency.

In the recording apparatus, the sheet member may be provided in a state in which one end thereof is fixed in a movement direction of the carriage, and the other end is drawn as a free end.

According to the aspect, since the sheet member is provided in the state in which the one end thereof is fixed in the movement direction of the carriage, and the other end is drawn as the free end, it is possible to suppress contraction of the sheet member which is caused by a difference in linear expansion coefficients between the sheet member and the frame. As a result, it is possible to secure smooth operation of the carriage.

In the recording apparatus, an insulating material may be provided between the sheet member and the frame.

When a difference in ionization tendency between metal is present in a case in which metal of different types come into contact with each other, corrosion occurs. According to the aspect, since the insulating material may be provided between the sheet member and the frame, it is possible to prevent or suppress corrosion which is caused due to the difference in ionization tendency.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment of the invention will be described based on drawings. The invention is not limited to embodiments which will be described below, can be variously modified in the scope of the invention which is described in claims, and one embodiment of the invention will be described below by assuming that those modifications are also included in claims.

Figure 1:
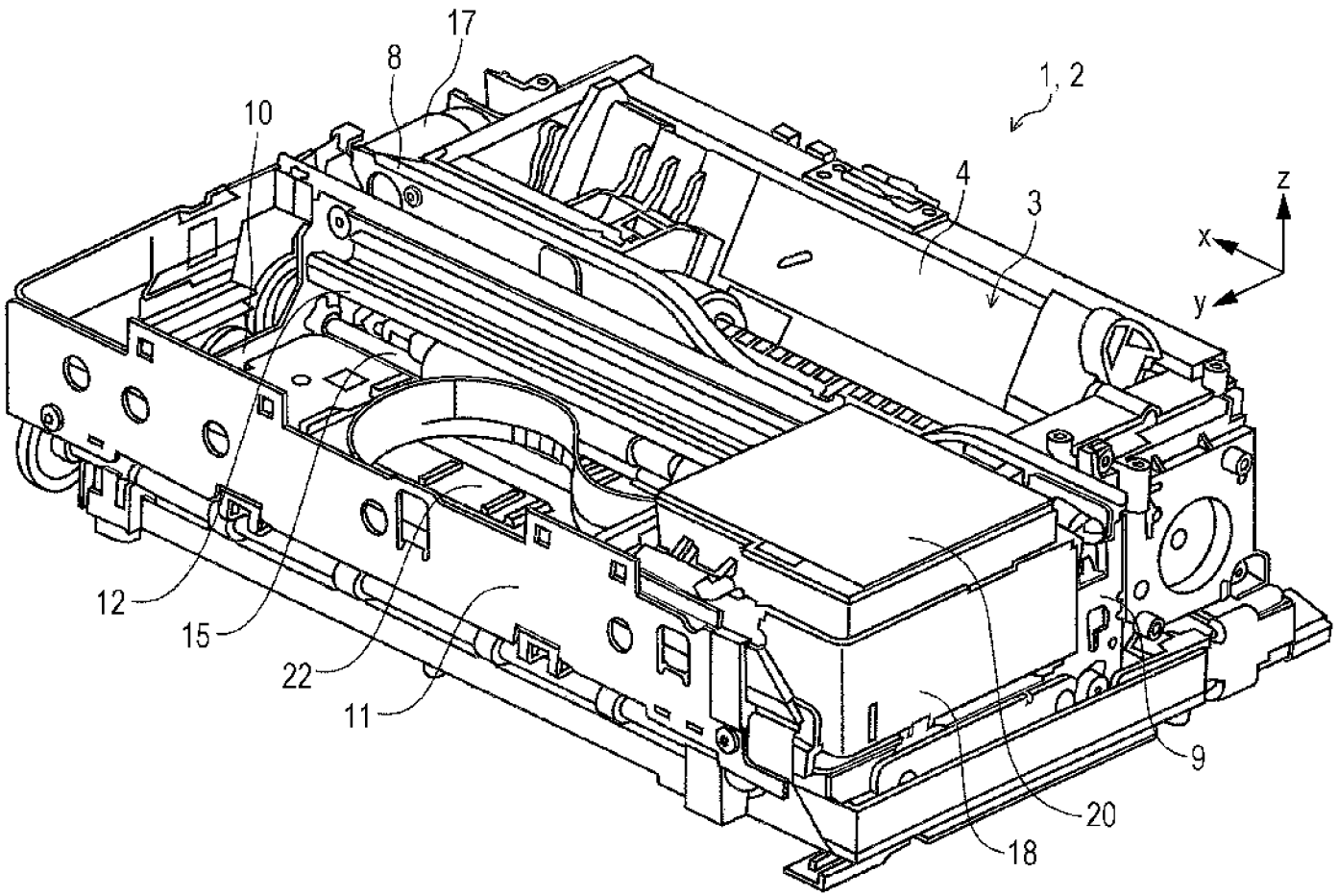
FIG. 1 is a perspective view of an apparatus main body of a printer according to an embodiment of the invention.
Figure 2:
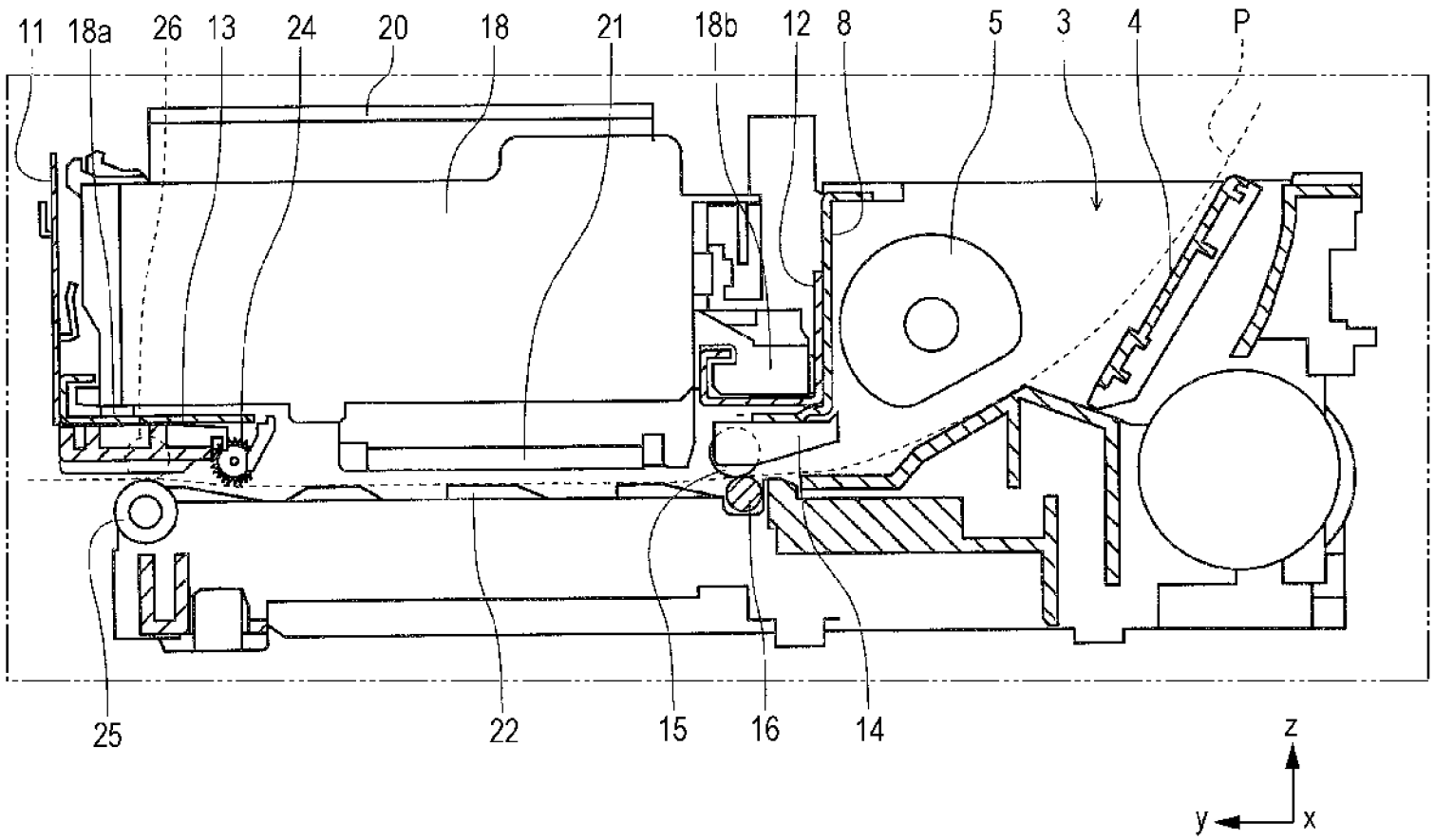
FIG. 2 is a side cross-sectional view of the printer according to the embodiment of the invention.
Figure 3:
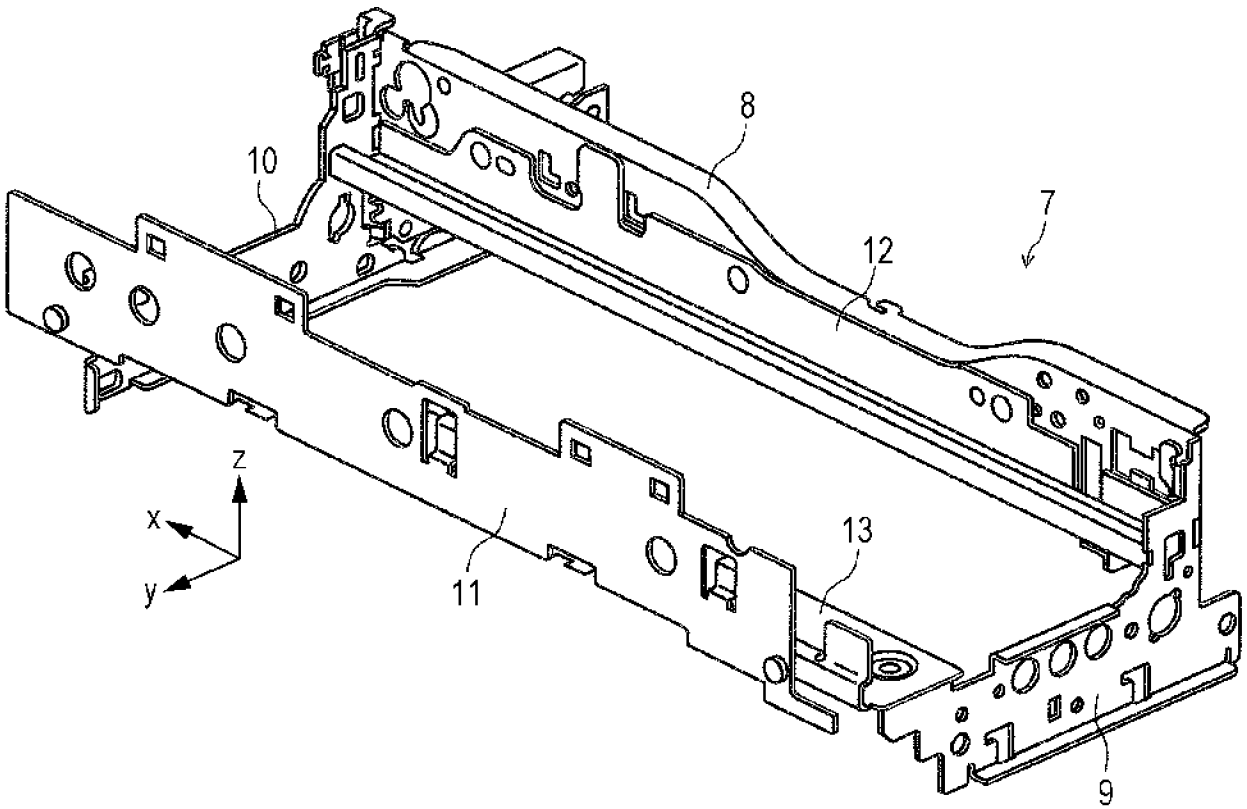
FIG. 3 is a perspective view of a frame assembly.
Figure 4:
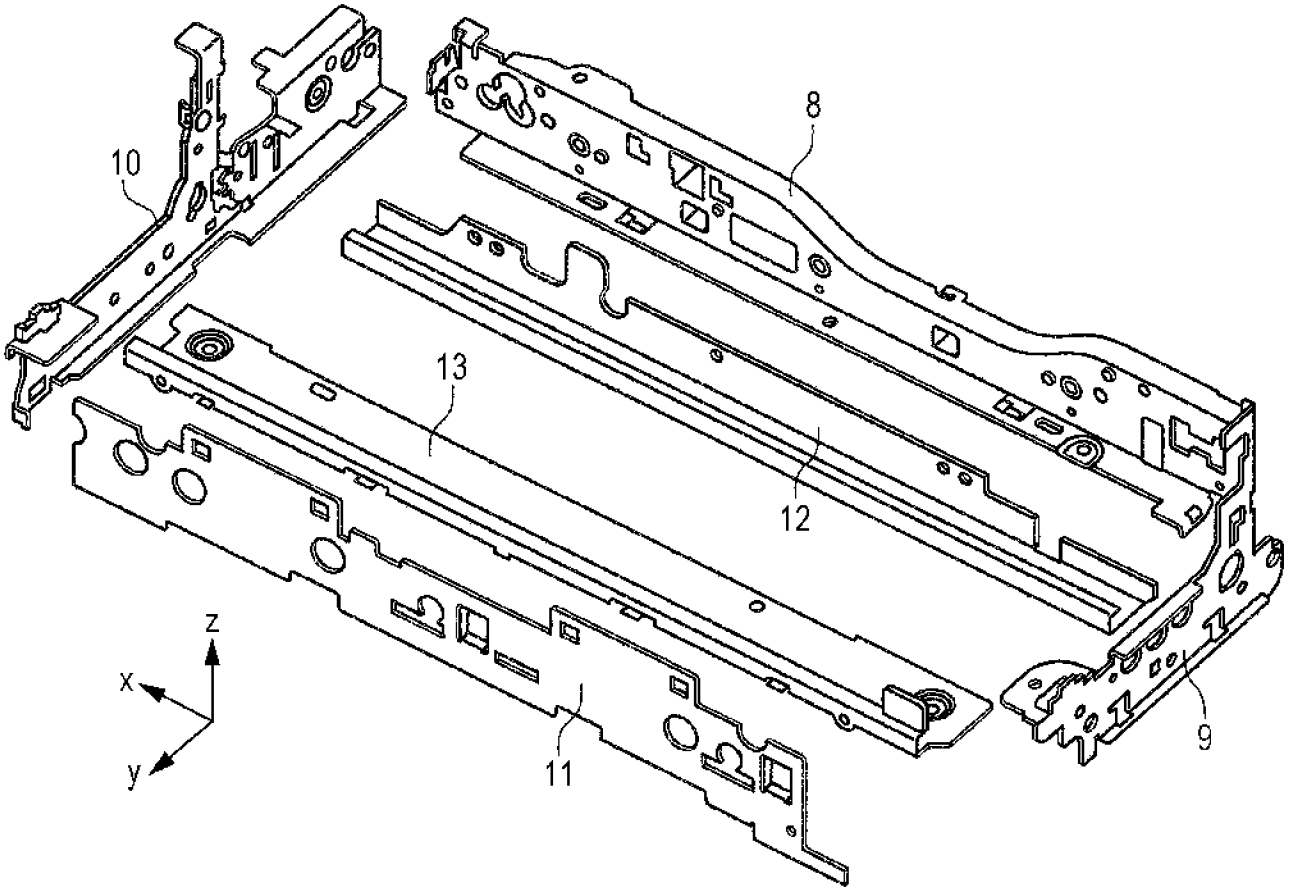
FIG. 4 is an exploded perspective view of the frame assembly.
Figure 5:
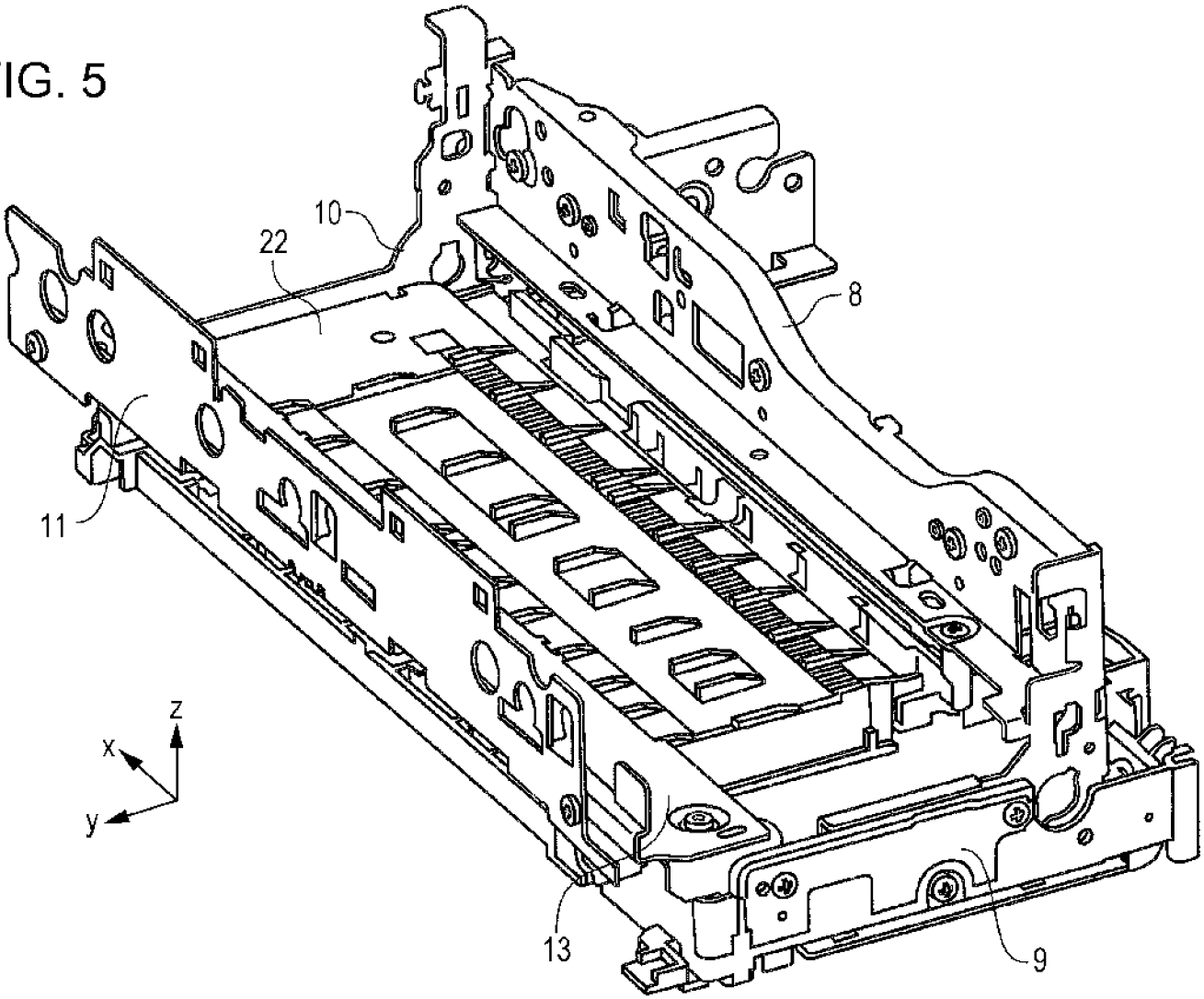
FIG. 5 is a perspective view of the frame assembly (diagram including sheet support member).
Figure 6:
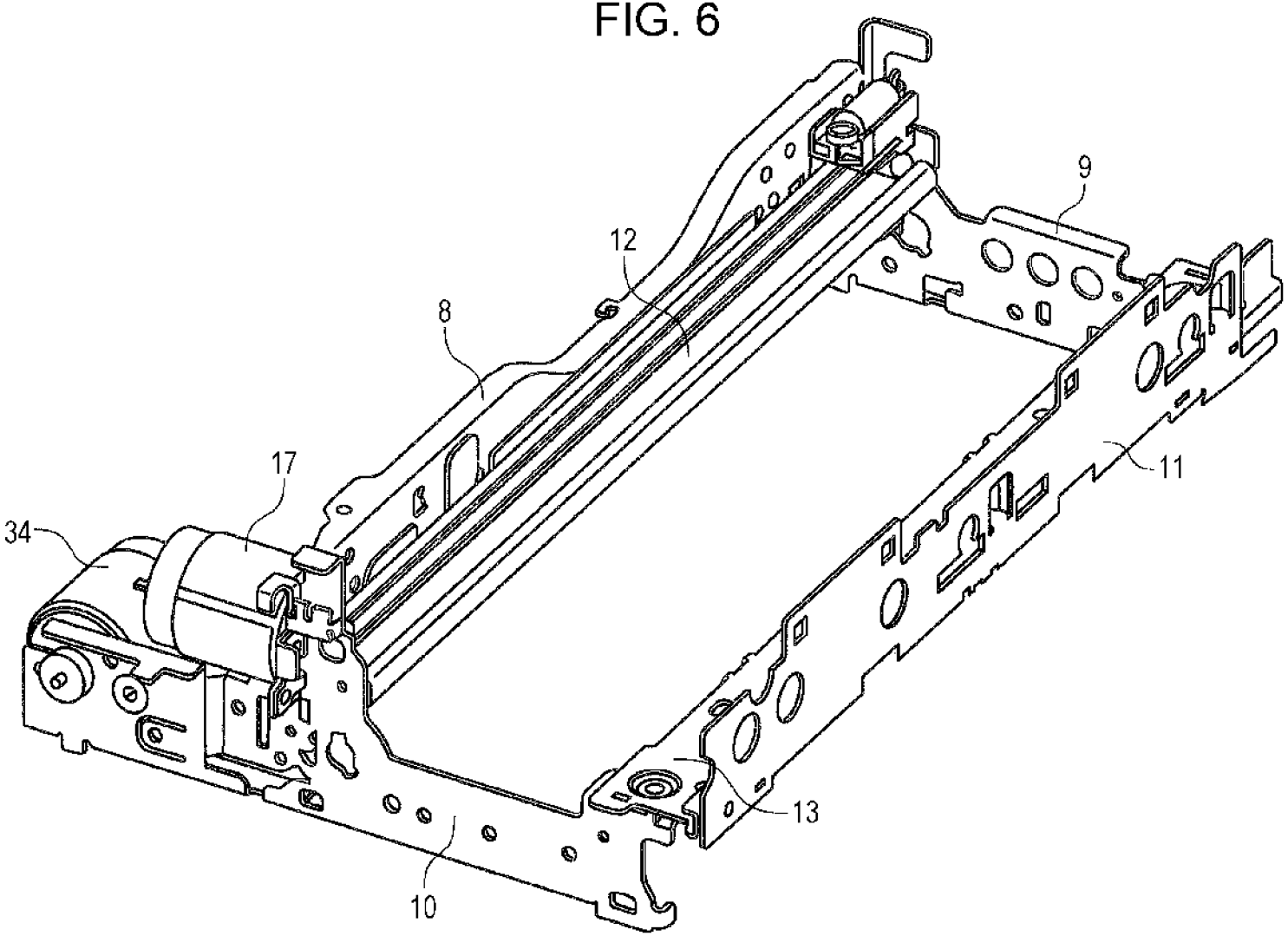
FIG. 6 is a perspective view of the frame assembly (diagram including motor).
Figure 7:
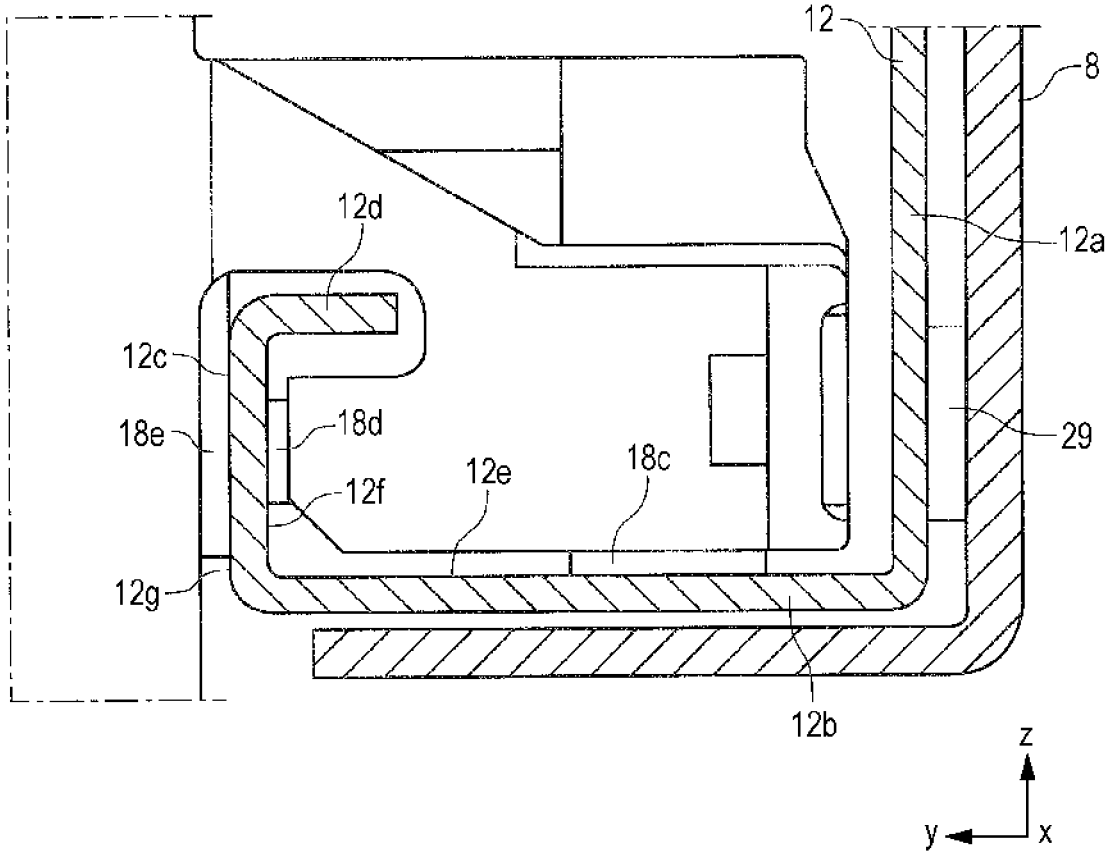
FIG. 7 is a side view of a second supported unit of a carriage and a guide frame (cross-sectional view).
Figure 8:
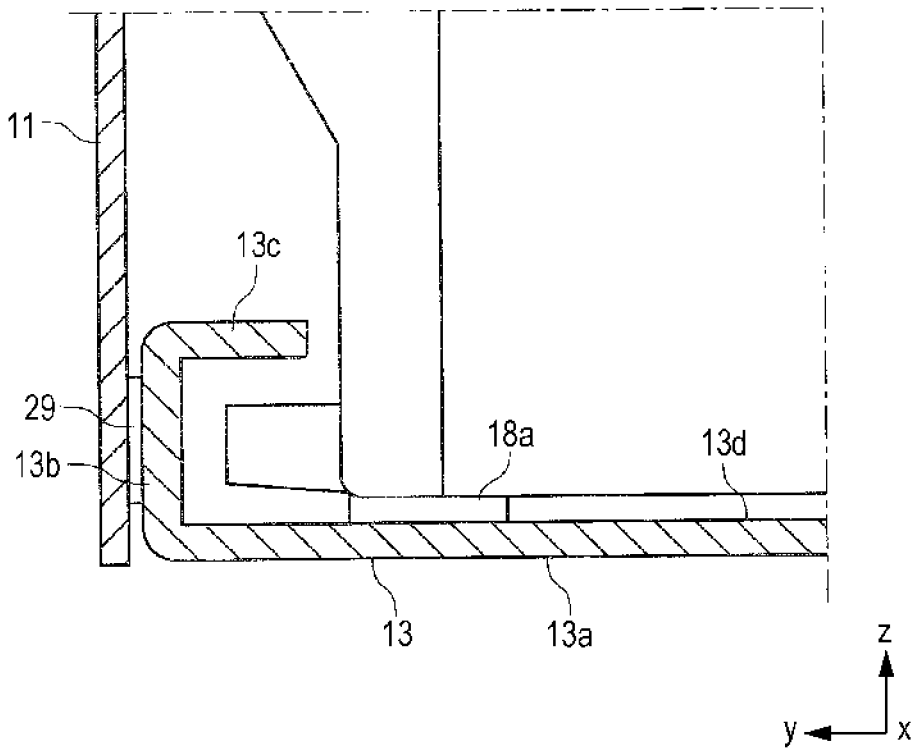
FIG. 8 is a side view of a first supported unit of the carriage and the guide frame (cross-sectional view).

FIG. 1 is a perspective view of an apparatus main body (state in which housing configuring appearance is removed) 2 of an ink jet printer (hereinafter, referred to as "printer") 1 which is one embodiment of a "recording apparatus" in the invention, FIG. 2 is a side cross-sectional view of the printer 1, FIG. 3 is a perspective view of a frame assembly 7, FIG. 4 is an exploded perspective view of the frame assembly 7, FIG. 5 is a perspective view of the frame assembly 7 (diagram including sheet support member 22, and in which guide frame 12 is omitted), FIG. 6 is a perspective view of the frame assembly (diagram including carriage driving motor 17 and sheet transport motor 34), FIG. 7 is a side cross-sectional view of a second supported unit 18*b* of a carriage 18 and a guide frame 12, and FIG. 8 is a side cross-sectional view of a first supported unit 18*a* and a guide frame 13.

Figure 9:
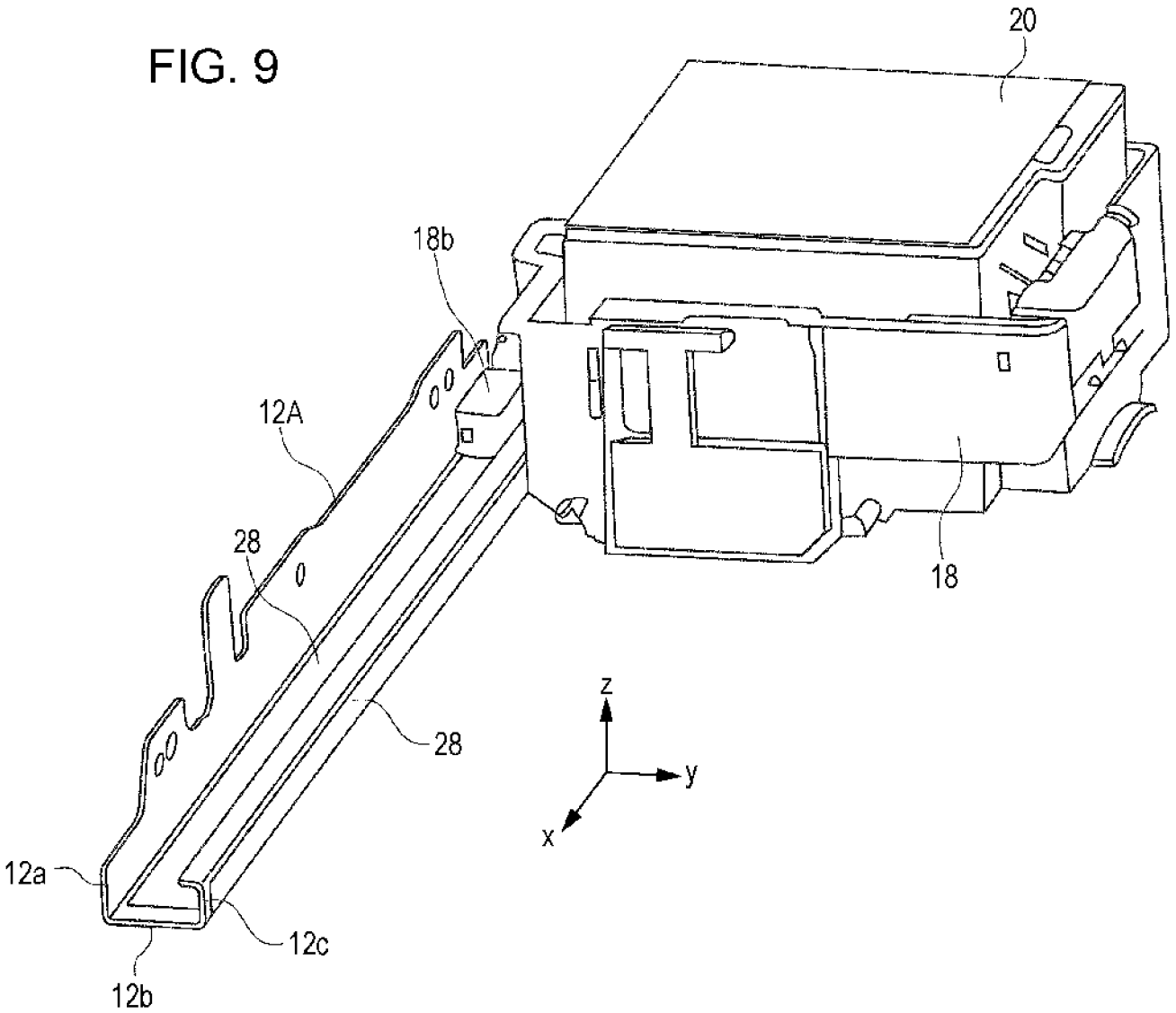
FIG. 9 is a perspective view of a guide frame and a carriage according to another embodiment.
Figure 10:
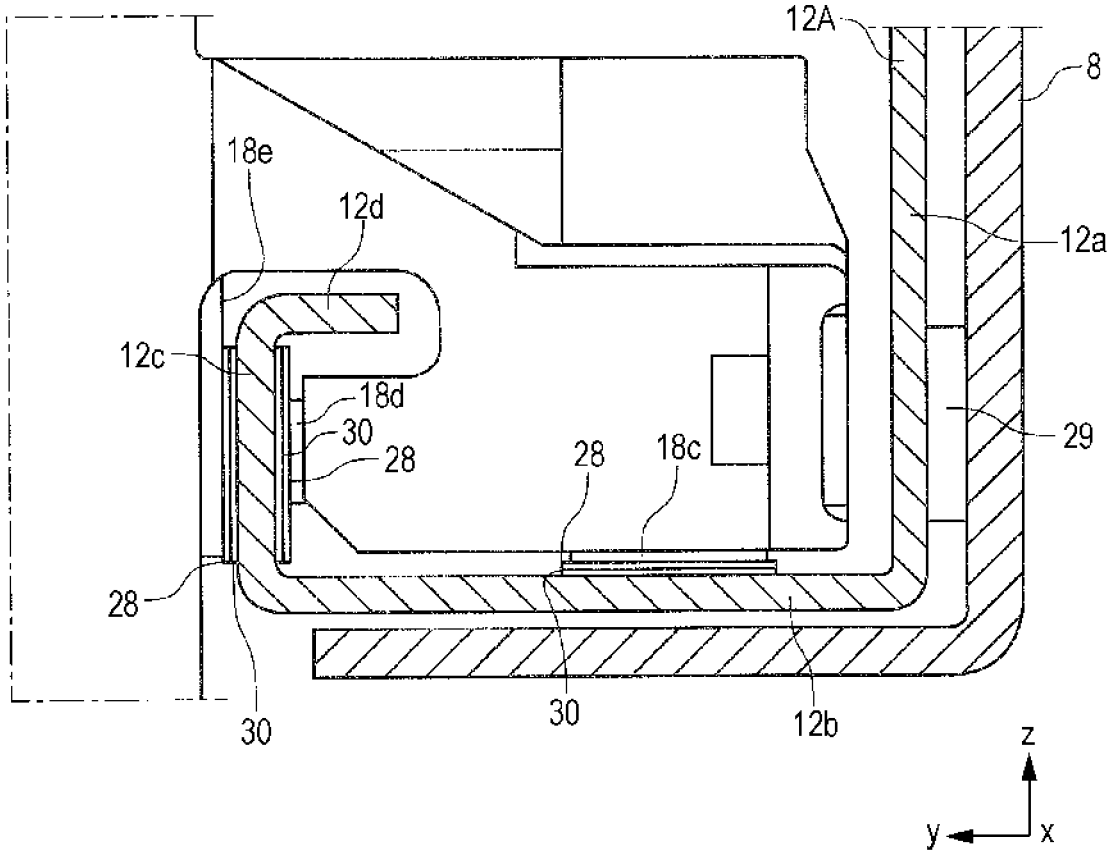
FIG. 10 is a side view of the second supported unit of the carriage and the guide frame according to another embodiment (cross-sectional view).
Figure 11:
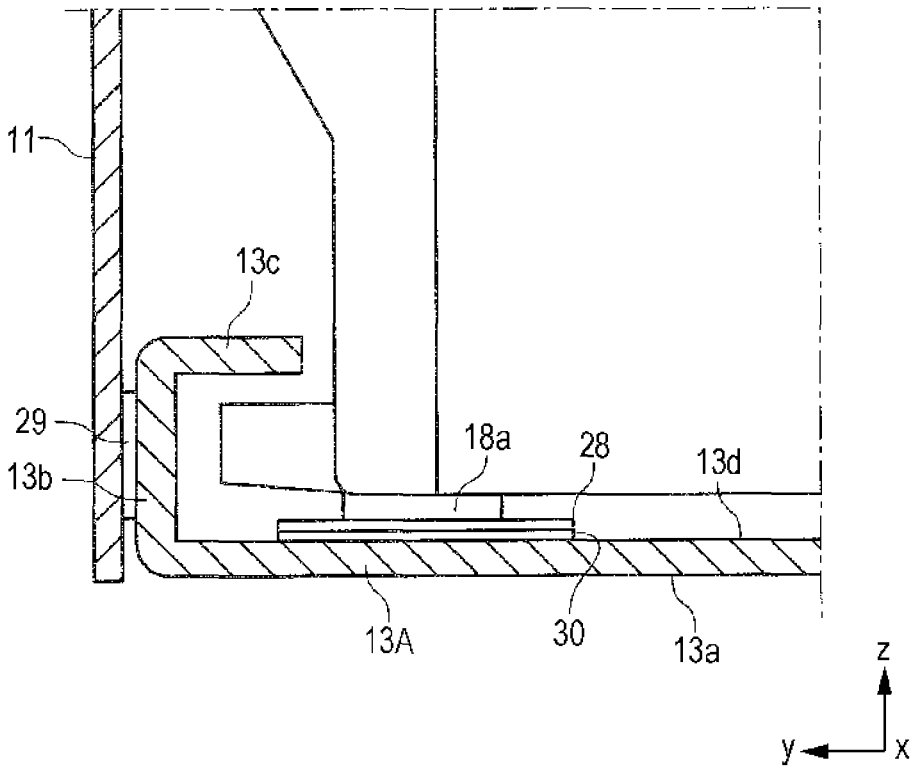
FIG. 11 is a side view of the first supported unit of the carriage and the guide frame according to another embodiment (cross-sectional view).
Figure 12B:
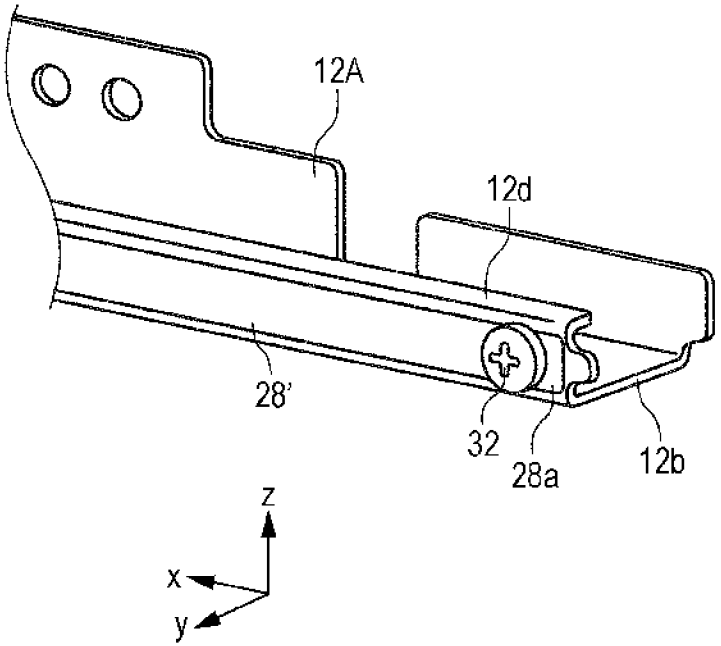
FIGS. 12A and 12B are perspective views of end portions of the guide frame according to another embodiment.
Figure 12A:
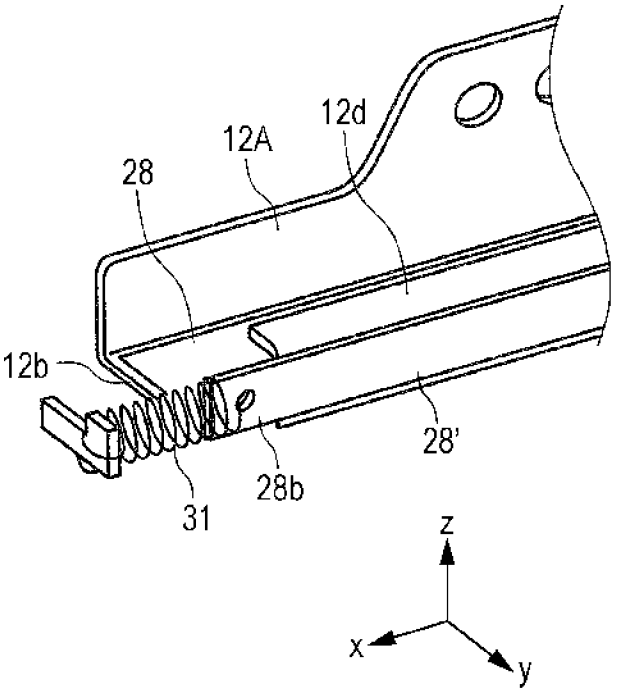

In addition, FIG. 9 is a perspective view of a guide frame 12A according to another embodiment and the carriage 18, FIG. 10 is a side cross-sectional view of the second supported unit 18*b* of the carriage 18 and the guide frame 12A according to another embodiment, FIG. 11 is a side cross-sectional view of the first supported unit 18*a* and a guide frame 13A according to another embodiment, and FIGS. 12A and 12B are perspective views of end portions of the guide frame 12A according to another embodiment.

In addition, in orthogonal coordinates of x-y-z in each figure, the x direction and y direction denote the horizontal direction, and among these, the x direction denotes the direction orthogonal to the sheet transport direction (sheet width direction), the horizontal direction of the apparatus, or the movement direction of the carriage (main scanning direction). In addition, a y direction is a sheet transport direction, and also is an apparatus depth direction. In addition, the z direction is the gravity direction, and also is the height direction of the apparatus.

Hereinafter, a configuration of the printer 1 will be schematically described with reference to FIGS. 1 and 2. The printer 1 is a so-called serial type ink jet printer in which recording is completed by alternately performing a recording operation and a sheet transport operation, and is miniaturized in consideration of portability. A base (frame) of the apparatus main body 2 of the printer 1 is configured using the frame assembly 7 (which will be described later) which is configured of a plurality of frames.

A sheet feeding port 3 in which a recording sheet (mainly cutform paper: hereinafter, referred to as "sheet P") as an example of a medium for recording can be set is provided on the rear side of the apparatus, and a plurality of the sheets P which are set in the sheet feeding port 3 are supported in an inclined posture using a hopper 4, and a paper support (not illustrated) which is located at the upper part of the hopper 4.

The hopper 4 causes the supported sheet P to advance or retreat with respect to the sheet feeding roller 5 when the hopper 4 slides around a sliding fulcrum which is not illustrated. A sheet on the top among the set sheets P comes into contact with the sheet feeding roller 5 when the hopper 4 ascends, and is sent to the downstream side due to a rotation of the sheet feeding roller 5.

A sheet transport unit including a transport driving roller 16 and a transport driven roller 15 is provided on the downstream side of the sheet feeding roller 5, and the sheet P is transported to the lower side of an ink jet recording head 21 using these rollers.

The ink jet recording head 21 is provided in the carriage 18, and the carriage 18 is equipped with an ink cartridge 20, receives power from a carriage driving motor (refer to FIG. 6), and reciprocates in the sheet width direction (x direction). In addition, according to the embodiment, the carriage 18 is a so-called on-carriage type which is equipped with the ink cartridge; however, the carriage may be a so-called off-carriage type in which the ink cartridge is provided separately from the carriage 18, and the ink cartridge and the recording head 21 are connected using an ink tube.

The carriage 18 includes the first supported unit 18*a* on the front side of the apparatus, and includes the second supported unit 18*b* on the rear side of the apparatus. The first supported unit 18*a* is supported by the guide frame 13, and the second supported unit 18*b* is supported by the guide frame 12. That is, the carriage 18 is supported by the guide frames 13 and 12. In addition, the first supported unit 18*a* is supported by the guide frame 13, and slides on the guide frame 13.

Similarly, the second supported unit 18*b* is supported by the guide frame 12, and slides on the guide frame 12. In addition, the guide frame 12 defines a position of the carriage 18 in the y direction. That is, the guide frame 12 guides the carriage 18 in the main scanning direction. In addition, the first supported unit 18*a*, the second supported unit 18*b*, and the guide frames 12 and 13 will be described in detail later.

Subsequently, the sheet support member 22 which supports the sheet P is provided at a position facing the ink jet recording head 21, and a discharging driving roller 25 and a discharging driven roller 26 which discharge the sheet P on which recording is performed are provided on the downstream side of the ink jet recording head 21 and the sheet support member 22. In addition, the reference numeral 24 denotes a regulating roller which regulates sheet flotation.

In addition, the sheet support member 22 as a medium support member is fixed to a main frame 8 and a side frame 10 as illustrated in FIG. 5. In addition, the reference numeral 34 in FIG. 6 denotes a sheet transport motor as a driving source of the transport driving roller 16 and the discharge driving roller 25, and the sheet transport motor 34 is fixed to the side frame 10. The carriage driving motor 17 is fixed to the main frame 8.

Hitherto, the printer 1 is schematically described, and hereinafter, the frame assembly 7 will be described with reference to FIG. 3 and thereafter.

The frame assembly 7 forms a base (frame) of the apparatus main body 2 as described above, is configured of a plurality of frames, and specifically, is configured of the main frame 8, a side frame 9, the side frame 10, a sub-frame 11, the guide frame 12, and the guide frame 13 as illustrated in FIGS. 3 and 4.

The main frame 8, the side frame 9, the side frame 10, and the sub-frame 11 exhibit the following function as "the first frame", and the guide frame 12 and the guide frame 13 exhibit the following function as "the second frame".

The main frame 8, the sub-frame 11, and the guide frames 12 and 13 form a shape which is extended in the sheet width direction, and the side frames 9 and 10 form a shape which is extended in the sheet transport direction.

The main frame 8 is extended in the vertical direction as illustrated in FIG. 2 in a cross-sectional view, forms a shape of which the upper part is bent in an L shape to the rear side of the apparatus, and forms a shape of which the lower part is bent in the L shape to the front side of the apparatus. The sheet feeding unit including the hopper 4 and the sheet feeding roller 5 is attached to the main frame 8. In addition, various constituent members such as the motor 17 which drives the carriage 18, the roller support member 14 (FIG. 2) which supports the transport driven roller 15, and the like, are assembled in the main frame.

The guide frame 12 forms a hook-like shape which is extended in the vertical direction as illustrated in FIG. 7 in a cross-sectional view, and of which the lower part is bent to the front side of the apparatus, is subsequently bent to the upper side, and is subsequently bent to the rear side of the apparatus. More specifically, the reference numeral 12*a* in FIG. 7 denotes a portion at which the guide frame 12 is extended in the vertical direction in the cross-sectional view (hereinafter, referred to as "vertical portion 12*a*"), the reference numeral 12*b* denotes a portion at which the guide frame is extended in the horizontal direction (hereinafter, referred to as "horizontal portion 12*b*"), the reference numeral 12*c* denotes a portion at which the guide frame is extended in the vertical direction (hereinafter, referred to as "second vertical portion 12*c*"), and the reference numeral 12*d* denotes a portion at which the guide frame is extended in the horizontal direction (hereinafter, referred to as "second horizontal portion 12*d*"). In this manner, when the guide frame 12 forms the hook-like shape in the cross-sectional view, an improvement of rigidness of the guide frame 12 in the longitudinal direction (sheet width direction) can be realized.

Here, the upper face 12*e* of the horizontal portion 12*b* in the guide frame 12 becomes a sliding face on which a slider 18*c* which is provided in the carriage 18 slides. In addition, sliders 18*d* and 18*e* are provided in the carriage 18, and between them, the slider 18*d* is provided so as to advance and retreat with respect to the slider 18*e*, and is provided in a state of being urged to the slider 18*e* side. In this manner, the second vertical portion 12*c* is interposed between the sliders 18*d* and 18*e*. In addition, along with the movement operation of the carriage 18, the sliders 18*d* and 18*e* slide on the second vertical portion 12*c*. The reference numeral 12*f* denotes a sliding face on which the slider 18*d* slides, and the reference numeral 12*g* denotes a sliding face on which the slider 18*e* slides. Accordingly, it is preferable that the sliding faces 12*e*, 12*f*, and 12*g* be smoothly formed.

On the other hand, the guide frame 13 which is provided on the front side of the apparatus forms a hook-like shape which is extended in the horizontal direction as illustrated in FIG. 8 in a cross-sectional view, of which the front side end portion of the apparatus is bent to the upper part, and is subsequently horizontally bent to the rear side of the apparatus. More specifically, the reference numeral 13*a* denotes a portion at which the guide frame is extended in the horizontal direction (hereinafter, referred to as "horizontal portion 13*a*") as illustrated in FIG. 8 in a cross-sectional view, the reference numeral 13*b* denotes a portion at which the guide frame is extended in the vertical direction (hereinafter, referred to as "vertical portion 13*b*"), and the reference numeral 13*c* denotes a portion at which the guide frame 13*a* is extended in the horizontal direction (hereinafter, referred to as "second horizontal portion 13*c*"). In this manner, by forming the guide frame in the hook-like shape in the cross-sectional view, an improvement of rigidness of the guide frame 13 in the longitudinal direction (sheet width direction) is realized.

In addition, the upper face (reference numeral 13*d*) of the horizontal portion 13*a* in the guide frame 13 becomes a sliding face on which the first supported unit (slider) 18*a* which is provided in the carriage 18 slides. Accordingly, it is preferable that the sliding face 13*d* be smoothly formed.

Subsequently, returning to FIGS. 3 and 4, the side frames 9 and 10 are joined with end portions of the guide frames 12 and 13, respectively, and various elements which configure a sheet transport path such as the transport driving roller 16, the discharging driving roller 25, the sheet support member 22, and the like, which are described with reference to FIG. 2 are assembled therein. According to the embodiment, the side frame 9 and the main frame 8 are integrally formed.

In addition, according to the embodiment, as a joining form of each frame, the main frame 8 and the guide frame 12 are joined using screw fixing. In addition, the main frame 8 and the side frame 10 are joined using screw fixing. In addition, the side frame 10 and the guide frame 13 are joined using screw fixing. In addition, the side frame 9 and the guide frame 13 are joined using screw fixing. In addition, the guide frame 13 and the sub-frame 11 are joined using screw fixing. However, the joining method of each frame is not limited to the screw fixing, and various joining methods such as fitting, bonding, welding, and other methods can be adopted.

The frame assembly 7 which is configured as described above configures the periphery of the carriage 18; however, in a relationship with the carriage 18, the frame assembly 7 is configured by including the first frame which does not form a contact face (sliding face) which comes into contact with the carriage 18, and the second frame which forms the contact face, and of which hardness is higher than that of the first frame.

That is, the frame assembly is configured by including the main frame 8, the side frames 9 and 10, the sub-frame 11 as the first frame, and the guide frames 12 and 13 as the second frame, and in which the second frame is formed of a material of which hardness is higher than that of the first frame. As an example, according to the embodiment, the main frame 8, the side frames 9 and 10, and the sub-frame 11 as the first frame are formed using aluminum or an aluminum alloy, and the guide frames 12 and 13 as the second frame are formed using an iron-based metallic material. In the specification, the iron-based metallic material is a term which forms a counterpart to nonferrous metal, and is iron and an alloy of which a main component is iron, and in which a zinc-coated steel sheet (SECC) is used as an example.

Since the frame assembly 7 is configured as described above, it is possible to realize weight reduction by forming the other frame (first frame) using the nonferrous metallic material such as the aluminum alloy or the like, while securing abrasion resistance on the sliding faces (12*e*, 12*f*, 12*g*, and 13*d*) on which the carriage 18 slides using the iron-based metallic material (second frame).

The above described configuration can be described as follows. That is, the frame assembly 7 is configured by including the main frame 8, the side frames 9 and 10, the sub-frame 11 as the first frame, and the guide frames 12 and 13 as the second frame which is located on the inside compared to the first frame, and is formed of a material of which specific gravity is greater than that of the first frame. In this manner, as described above, it is possible to realize weight reduction using the other frame (first frame) while securing abrasion resistance on the sliding faces (12*e*, 12*f*, 12*g*, and 13*d*) on which the carriage 18 slides using the second frame.

In addition, since the specific gravity of the first frame (main frame 8, side frames 9 and 10, and sub-frame 11) which is located on the outer side is less than that of the second frame (guide frames 12 and 13) which is located on the inside, the weight of the printer on the outer side becomes light in the whole printer. Due to this, an impact when the printer 1 is inclined to an installation face of the printer 1, and lands on the installation face after taking hands away from the printer is relieved. As a result, in the ink jet recording head 21 in particular, it is possible to suppress dot omission which occurs along with the drop impact.

In addition, since the guide frames 12 and 13 as the second frame suppress abrasion which occurs along with engagement with the carriage 18, it is preferable to form the guide frames using a material with Vickers hardness equal to or greater than 100, and it is more preferable to form the guide frames using a material with Vickers hardness equal to or greater than 200. In addition, it is preferable to form the main frame 8, the side frames 9 and 10, and the sub-frame 11 as the first frame using a material of which specific gravity is less than that of the ferrous metallic material (for example, material of which specific gravity is less than 7) in order to realize weight reduction of the apparatus.

In addition, it is preferable to make ionization tendencies in the first frame and the second frame close, since corrosion occurs due to a difference in ionization tendency when different metals are joined. When there is a difference in ionization tendency, it is preferable to provide an insulating material at the junction of the first frame and the second frame.

The reference numeral 29 in FIGS. 7 and 8 denotes the insulating material. The insulating material 29 in FIG. 7 prevents a direct contact of the main frame 8 and the guide frame 13. The insulating material 29 in FIG. 8 prevents a direct contact of the guide frame 12 and the sub-frame 11. It is possible to form the insulating material using a resin material, for example.

In addition, in addition to the method of interposing the insulating material between different metals as described above, the different metals may be insulated from each other by painting either or both of the frames, for example. According to the embodiment, it is preferable to perform insulation by painting the main frame 8 and the sub-frame 11, when considering abrasion, since the guide frames 12 and 13 form the sliding face on which the carriage 18 slides.

Subsequently, another embodiment will be described while referring to FIG. 9 and thereafter. In the embodiment in FIGS. 9 to 12, the contact face (sliding face) which comes into contact with the carriage 18 in the frame assembly 7 is configured of a sheet member of which hardness is higher than that of the frame. More specifically, in FIGS. 9 to 12, the reference numerals 12A and 13A correspond to the guide frames 12 and 13 in the above described embodiment, respectively; however, the guide frames are formed using aluminum or an aluminum alloy similarly to other frames, differently from the above described guide frames 12 and 13 (formed of nonferrous metallic material). In this manner, the whole apparatus is further reduced in weight.

The reference numeral 28 is the sheet member which is provided on a face with which the carriage 18 comes into contact in the guide frames 12A and 13A, and as an example, the sheet member is formed using a material of which hardness is higher than that of the guide frames 12A and 13A which are formed using aluminum or an aluminum alloy, for example, SUS. The sheet member 28 is provided over the entire region with which the carriage 18 comes into contact in the guide frames 12A and 13A. In this manner, it is possible to form the guide frames 12A and 13A using a material of which specific gravity is small while securing abrasion resistance on the sliding face on which the carriage 18 slides using the sheet member 28, and to realize weight reduction of the whole apparatus.

As the sheet member 28, it is preferable to use a material of which abrasion resistance is excellent, such as SUS as described above, and to use a material of which Vickers hardness is equal to or greater than 200 as the hardness.

In addition, it is possible to easily adjust a gap between the sheet support member 22 and the ink jet recording head 21 by adjusting the thickness of the sheet member 28.

In addition, since there is a concern that corrosion may occur due to a difference in ionization tendency between the guide frames 12A, 13A and the sheet member 28, as well, according to the embodiment, an insulating material 30 is interposed between the guide frames 12A, 13A and the sheet member 28, as illustrated in FIGS. 9 and 10. It is also possible to configure the insulating material 30 using a double-sided tape or an adhesive which bonds the sheet member 28 to the guide frames 12A and 13A, for example.

In this case, it is also possible to perform a surface treatment for improving an adhesive property on at least either of a bonding face in the guide frames 12A and 13A, and a bonding face in the sheet member 28. In the surface treatment, it is possible to adopt various processes for improving the adhesive property such as a primer treatment, a mechanical treatment (grinding of bonding face using polishing, or the like), or the like.

In addition, it is preferable to form a face on the side opposite to the bonding face in the sheet member 28, that is, the sliding face with which the carriage 18 comes into contact to be a smooth face.

In addition, when a difference in linear expansion coefficient between the guide frames 12A, 13A and the sheet member 28 is large, there also is a concern that the sheet member 28 may be separated from the guide frames 12A and 13A due to a change in temperature, or the carriage 18 may not smoothly slide due to contraction of the sheet member 28. In such a case, it is possible to provide the sheet member 28 in a state in which one end of the sheet member 28 in the movement direction of the carriage 18 is fixed, and the other end is set to be a free end, and is applied with a tensile force.

FIGS. 12A and 12B illustrate such an embodiment, the reference numeral 28*a* in FIG. 12A denotes one end which is fixed in a sheet member 28' (hereinafter, referred to as "fixed end 28*a*"), and the reference numeral 28*b* denotes the other end to which a tensile force is applied in the sheet member 28' (hereinafter, referred to as "free end 28*b*"). The reference numeral 32 is a screw which fixes the fixed end 28*a* to the guide frame 12A. The reference numeral 31 is a tension spring which draws the free end 28*b*.

In this manner, since the sheet member 28' is provided in a state of being applied with a predetermined tension in a state in which the entire member is not bonded to the guide frame 12A, and the fixed end 28*a* is fixed and the free end 28*b* is drawn, it is possible to prevent separation, contraction, flapping, or the like, of the sheet member 28' which is caused by a difference in linear expansion coefficient between the sheet member 28' and the guide frame 12A. As a result, it is possible to secure a smooth operation of the carriage 18.

It is needless to say that each constituent element in each embodiment which is described above is not limited to the disclosed contents, and can be appropriately modified. For example, in the embodiment which is described while referring to FIGS. 9 to 12, the sheet member 28 is used on the face on which the carriage 18 slides in the guide frames 12A and 13A; however, it is also possible to perform a surface treatment which improves any one of abrasion resistance, a sliding property, and hardness, for example, plating, painting, coating, quenching, or the like, instead of using the sheet member.

In addition, even in a case in which the printer 1 is not a type which performs recording while the carriage 18 is reciprocating in a predetermined direction, and is a so-called line head type in which a recording head is provided in a fixed manner, it is possible to adopt the following configuration, and to obtain an operation effect using the configuration.

That is, in the frame assembly 7, it is possible to make the weight on the outer side light in the whole printer, and to suppress dot omission which occurs when the printer 1 is applied with impact, due to the light weight, by using a material of which specific gravity is less than that of the second frame (guide frames 12 and 13) which is located inside, in the first frame (main frame 8, side frames 9 and 10, and sub-frame 11) which is located on the outside.

In addition, in the above described embodiment, the main frame 8, the side frames 9 and 10, and the sub-frame 11 as the first frame are separately formed; however, it may be also possible to form an integrated frame which forms a square shape when planarly viewed, by integrally forming the frames.

The entire disclosure of Japanese Patent Application No. 2013-261113, filed Dec. 18, 2013 is expressly incorporated by reference herein.

What is claimed is:

1. A recording apparatus comprising:

a carriage including a recording head which performs recording on a medium, and can move in a predetermined direction;

a frame which is configured along a range of which the carriage moves, and a sheet member which is provided on the frame, and has a sliding face on which a slider of the carriage slides, wherein a hardness of the sheet member is higher than a hardness of the frame.

2. The recording apparatus according to claim 1, wherein the sheet member is provided in a state in which one end thereof is fixed in a movement direction of the carriage, and the other end is drawn as a free end.

3. The recording apparatus according to claim 1, wherein an insulating material is provided between the sheet member and the frame.

4. A recording apparatus comprising:

a carriage including a recording head which performs recording on a medium, and can move in a predetermined direction;

a first frame being made of nonferrous metallic material, and having a main frame which is configured along a range of which the carriage moves; and a second frame being made of iron-based metallic material, and having a first sliding face on which a first slider of the carriage slides.

5. The recording apparatus according to claim 4, wherein the nonferrous metallic material of the first frame is aluminum or an aluminum alloy.

6. The recording apparatus according to claim 4, further comprising:

a medium support member which supports a medium at a position of facing the recording head, wherein the first frame has a pair of side frames which are formed on both sides of the main frame of the first frame, and wherein the medium support member is fixed to the pair of side frames.

7. The recording apparatus according to claim 6, further comprising:

a transport driving roller which transports the medium, wherein the transport driving roller is supported to the pair of the side frames of the first frame.

8. The recording apparatus according to claim 4, further comprising:

a carriage driving motor which drives the carriage, wherein the carriage driving motor is fixed to the main frame of the first frame.

9. The recording apparatus according to claim 8, further comprising:

a sheet feeding unit which includes a sheet feeding roller and a hopper, wherein the sheet feeding unit is attached to the main frame of the first frame.

10. The recording apparatus according to claim 4, wherein an insulating material is provided between the first frame and the second frame at a junction of the first frame and the second frame.

11. The recording apparatus according to claim 4, wherein the first frame further comprises a sub-frame which is configured along a range of which the carriage moves, the sub-frame is separated from the main frame in a direction intersecting the movement direction of the carriage, wherein the second frame further comprises a second sliding face on which a second slider of the carriage slides.

12. A recording apparatus comprising:

a carriage including a recording head which performs recording on a medium, and can move in a predetermined direction;

a first frame having a main frame which is configured along a range of which the carriage moves; and a second frame having a sliding face on which a slider of the carriage slides, wherein a specific gravity of material of the first frame is less than a specific gravity of material of the second frame.

13. The recording apparatus according to claim 12, further comprising:

a transport driving roller which transports the medium, wherein the first frame has a pair of side frames which are formed on both sides of the main frame of the first frame, and wherein the transport driving roller is fixed to the pair of side frames.

* * * * *